US005564710A

United States Patent [19]

Bolding et al.

[11] Patent Number: 5,564,710

[45] Date of Patent: Oct. 15, 1996

[54] WORD FORMING CARD GAME HAVING A TOP

[76] Inventors: Pam Bolding, 424 Ray La.; Cathy Mason, 7516 Georgia Ridge Rd., both of Alma, Ark. 72921

[21] Appl. No.: 502,737

[22] Filed: Jul. 11, 1995

[51] Int. Cl.[6] ..... A63F 1/04

[52] U.S. Cl. ..... 273/299; 273/147; 273/272

[58] Field of Search ..... 273/268, 272, 273/146, 147, 299

[56] References Cited

U.S. PATENT DOCUMENTS

| | | | |
|---|---|---|---|
| 4,076,252 | 2/1978 | Bernier et al. | 273/147 |
| 4,306,725 | 12/1981 | Sawyer | 273/299 |
| 5,409,237 | 4/1995 | Marcley et al. | 273/299 |

*Primary Examiner*—William M. Pierre
*Attorney, Agent, or Firm*—Stephen D. Carver; Trent C. Keisling

[57] ABSTRACT

A multiple player word forming game is disclosed. The game uses a board, a cup and a plurality of cards. The cards are randomly transferred to and from the players. The players use the cards to form words. In the best mode, a game board defines a flat surface bounded by a peripheral wall upon which the cup freely travels about. A player begins a turn by spinning the cup, which eventually lands upon a card transfer space. The card transfer space dictates whether the player either draws or passes cards. The player transfers cards either from the deck or to a discard pile or to or from another player during a turn. Then the player attempts to spell a word by selecting cards in his hand and laying them face-up in front of him. Opponents may challenge the player's word. Any player who transfers all of his cards during a set becomes empty-handed and may not challenge words. The number of points earned by each player is dependent upon their performance both in forming words and in manipulating the number of cards in their hand. Preferably, a chance card multiplies the number of points a player can get. The set ending player's total score is doubled if the player ended the set with the chance card. Other player's scores are multiplied by zero if they held the chance card when an opponent ended the set.

14 Claims, 4 Drawing Sheets

WORD FORMING CARD GAME HAVING A TOP

BACKGROUND OF THE INVENTION

I. Field of the Invention

The present invention relates generally to multiple player word forming games. More particularly, the present invention relates to a multiple player, word forming board game utilizing a plurality of "lettered" cards that are assembled into a word to score points. The number of cards held by a player are varied by a free traveling chance generator that spins across the board.

II. Description of time Prior Art

As will be recognized by those skilled in the art, a wide variety of word forming games already exist. For example, of some relevance to the present invention are the games disclosed by U.S. Pat. Nos. 4,877,255, 3,226,122, 3,565,439, 4,826,175, 4,923,199 and 1,685,723.

U.S. Pat. No. 4,877,255 to Von Braunhut discloses a game utilizing a deck of playing cards having letters thereon. The players draw cards and attempt to spell words. In one preferred embodiment of the game, the words are then used as acronyms in sentences. The game also uses a central board and various score pads.

U.S. Pat. No. 4,826,175 teaches a card word game similar to "gin rummy". Players draw and discard a card while trying to spell words with held cards. At the beginning of their turn, players have the option of choosing from a draw pile or a discard pile. U.S. Pat. No. 4,923,199 teaches a word game that utilizes a deck of cards having letters that are dependent upon their frequency of use in the English language. In other words, the more commonly used letters appear more often in the card deck. The players are dealt a number of cards at the beginning and try to spell words using the cards they are dealt.

Each of the games disclosed in the aforementioned prior art patents employs a plurality of cards which are used to form words.

U.S. Pat. No. 3,226,122 to Rogers shows an interesting rotational selector (reference number 10 in FIG. 1) that spins like a roulette wheel. The selector is rotated and indicates letters to be used in spelling words. More than one letter may be indicated simultaneously. U.S. Pat. No. 3,565,439 shows a game having cards with letters thereupon. A numbered spinner indicates the number of letters the players must use in a particular word.

U.S. Pat. No. 1,685,723 discloses a word-spelling game wherein players use a spinner dial to determine who goes first. The object of the game is to try to spell words from drawn tiles.

While other such games employ word-forming devices and strategies, no game of which I am aware provides a random chance generator that varies the tactical strategy every round for each player.

Further, the known prior art word forming games, while often intellectually stimulating, lack the sensory gratification necessary to attract and entertain younger, often unfocused minds. In other words, while word games are often entertaining for adults because of the intellectual challenge inherent in forming words, word games often fail to entertain children because they find it difficult to concentrate on the intellectual aspect of the game without additional sensory stimulation.

Hence, it is desirable to provide an entertaining and challenging game which may be enjoyed by a number of players of various skill levels and ages.

SUMMARY OF THE INVENTION

The present invention comprises a unique word forming game for two or more players in which lettered cards are unpredictably transferred. The players use the cards to form words. A chance generating device or cup is used to variably determine the number of cards either drawn or passed either to the deck or another player during a player's turn.

Preferably, the number of points earned by each player is dependent upon their performance both in forming words and in manipulating the number of cards in their hand.

In the best mode, a game board defines a flat surface upon which the cup freely travels across. Each player forcefully spins the cup in turn and follows the instructions of the space in which the cup stops.

Each player either draws or passes cards depending upon the dictates of the randomly selected card transfer space. Then the player attempts to spell a word using the remaining cards in the hand. Opponents may challenge the player's word.

Any player who either gives all or has all of his cards drawn from him during a set becomes empty-handed. Empty-handed players may not challenge opponents words and may only use draw spaces. Other players are not able to draw from empty-handed opponents. If a player is directed to draw from another player and all opponents are empty-handed, the player does not get to draw and must continue the turn without receiving any additional cards. Players who remain empty-handed for three consecutive turns may draw from the deck.

Players get points for spelling words and for managing the cards in their hands. At the end of a set, points are totaled and tallied. The player ending the set gets bonus points and points for each letter of each spelled word. The other players get the points for each letter of each spelled word minus the total of all cards held when the set ended.

A chance card multiplies the number of points the player receives. The multiplier depends upon whether or not the player holding the chance card ended the set or not. Preferably, the set ending player's total score is doubled if the player ended the set with the chance card. Another player's score is multiplied by zero if he or she held the chance card when an opponent ended the set.

Thus, the players must anticipate the possible results of a given spin when contemplating strategies for formulating and maximizing their points. Because of the chance elements involved in this otherwise intellectually oriented game, younger or less experienced players may often gain an advantage and enjoy competing with older and more experienced players. Also, because of the fascinating and mesmerizing movements of the spinning cup, the game attracts and retains the attention of the players.

Thus, a broad object of the present invention is to provide an intellectually challenging word forming game for participation by two or more players.

Yet another basic object of the present invention is to provide an intellectually satisfying word forming game of the character described which may be played concurrently by two or more players having varying degrees of skill.

A related object of the present game is to provide a stimulating game that is fun to play.

Another object of the present invention is to provide a game that is visually stimulating while building word forming skills.

These and other objects and advantages of the present invention, along with features of novelty appurtenant thereto, will appear or become apparent in the course of the following descriptive sections.

BRIEF DESCRIPTION OF THE DRAWINGS

In the following drawings, which form a part of the specification and which are to be construed in conjunction therewith, and in which like reference numerals have been employed throughout wherever possible to indicate like parts in the various views.

DETAILED DESCRIPTION

Figure 1:
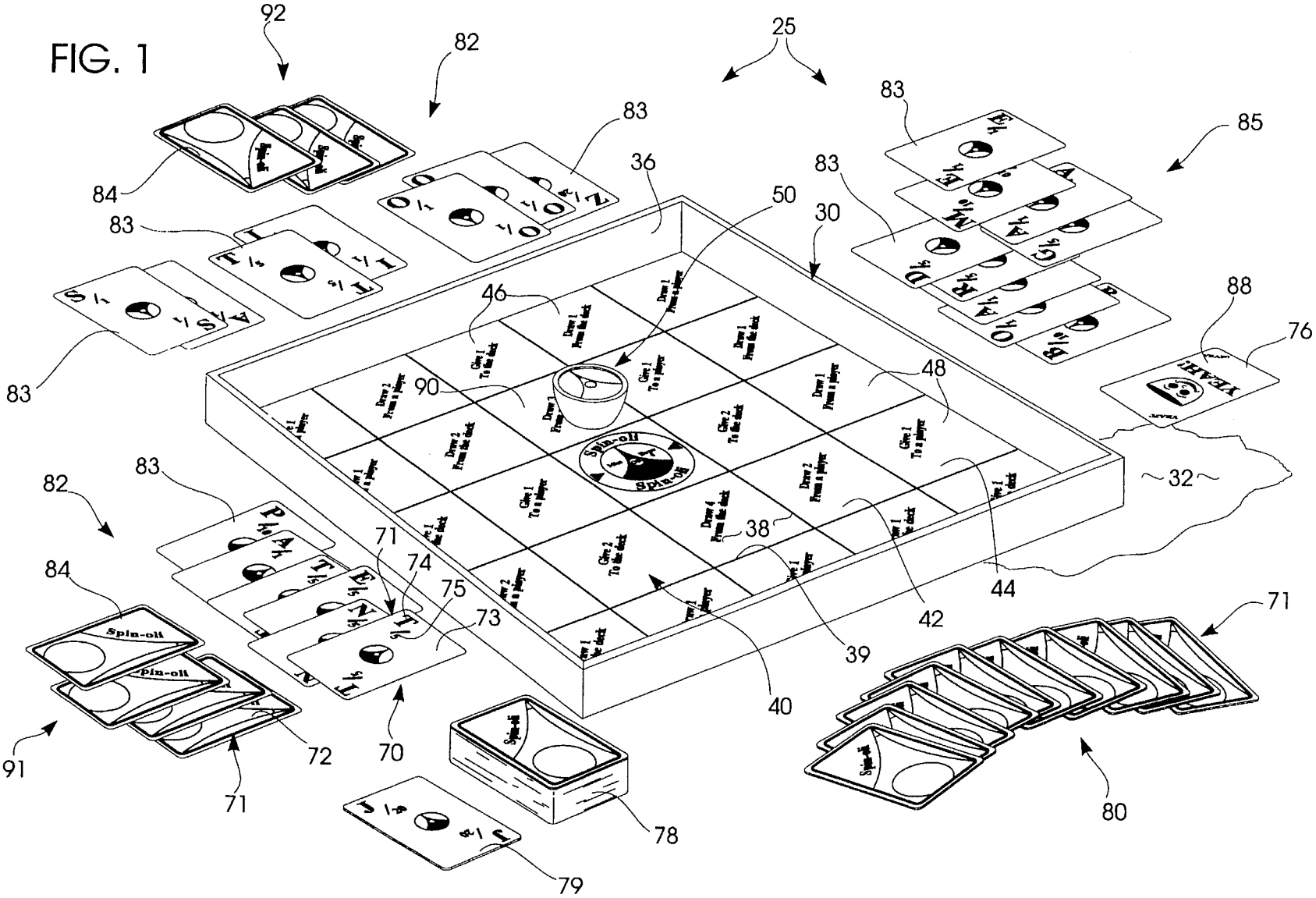
FIG. 1 is an environmental view of the best mode of our Word Game showing several hands of cards at various levels and the spinning cup on the board.
Figure 2:
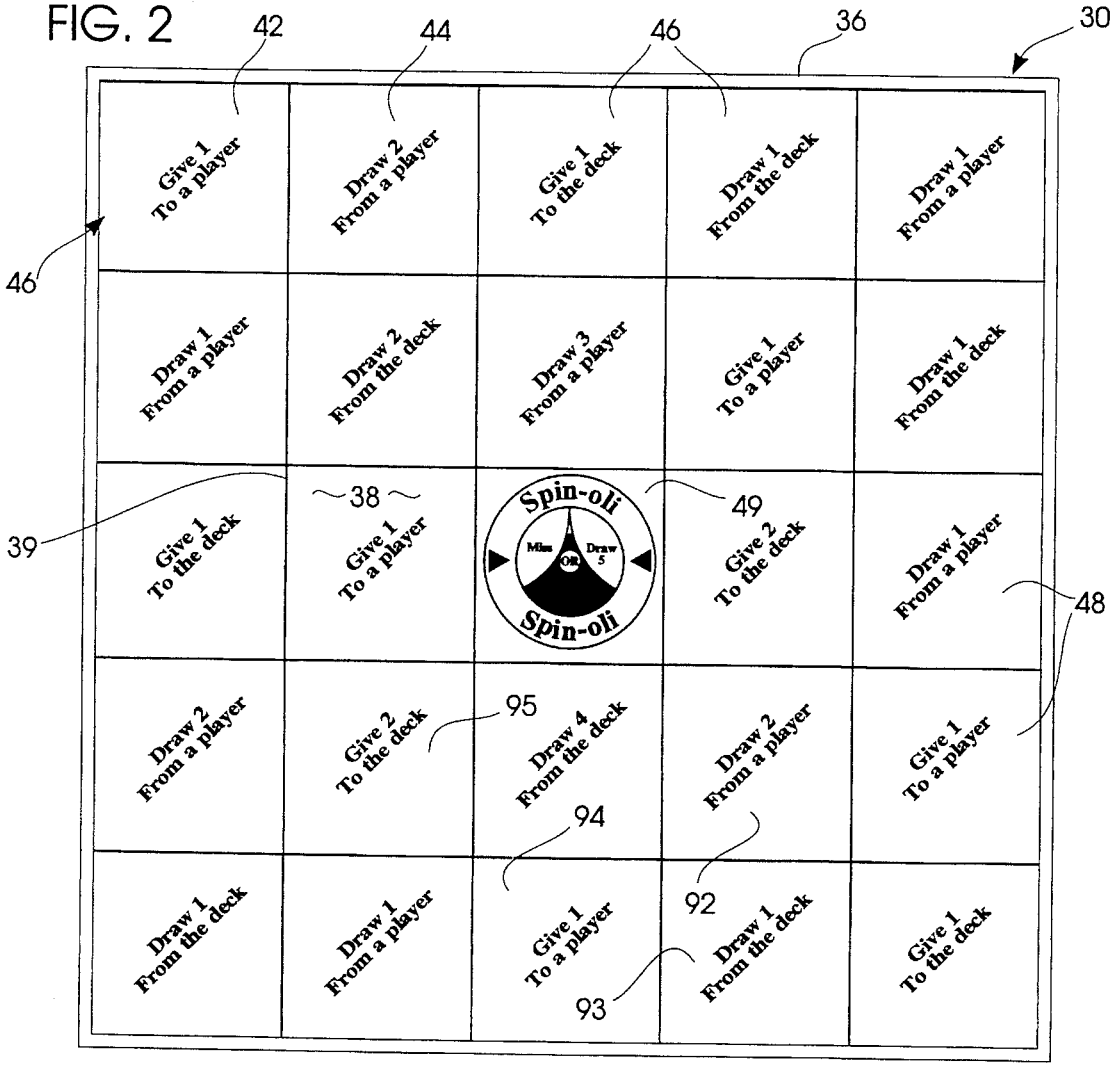
FIG. 2 is a top plan view of the board shown in FIG. 1.
Figure 3:
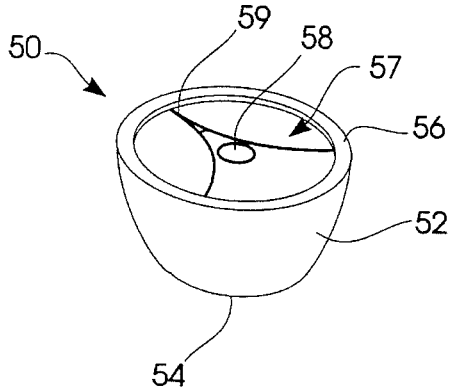
FIG. 3 is an isometric view of the cup.
Figure 4:
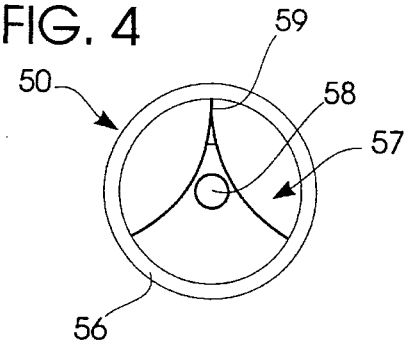
FIG. 4 is a top plan view of the cup.
Figure 5:
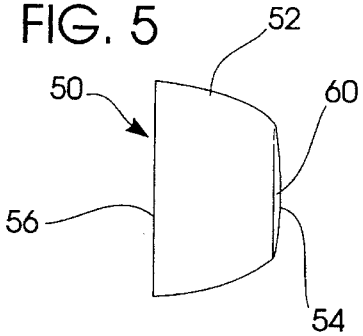
FIG. 5 is a side elevational view of the cup, with the opposite side being a mirror image thereof.
Figure 6:
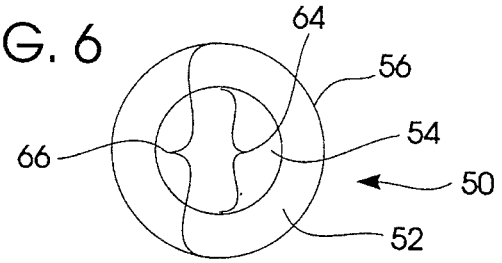
FIG. 6 is a bottom plan view of the cup.
Figure 7:
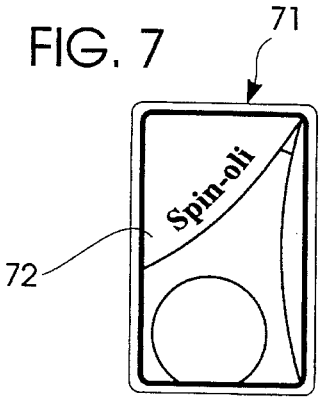
FIG. 7 is a top plan view of a card shown in FIG. 1, with the card face-down.
Figure 8:
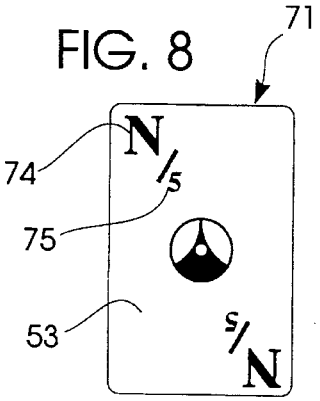
FIG. 8 is a bottom plan view of the card shown in FIG. 7, with the card face-up and showing the letter and point value associated with the card.
Figure 9:
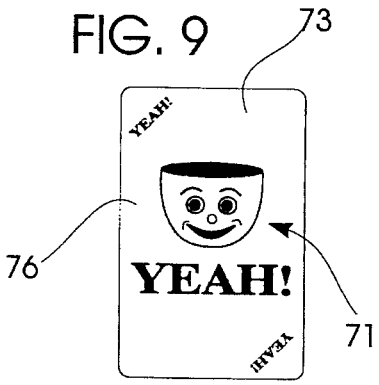
FIG. 9 is a bottom plan view of the "YEAH" chance card.

Our word forming game permits two or more players of differing ages or skill levels to be competitively entertained. The game is generally designated by reference numeral 25 in FIGS. 1–11. The principle components of game 25 are a playing board 30, a cup 50 and a set of cards 70.

Generally, the board rests upon a supporting surface, such as table 32. During play, cup 50 is spun on board 30 to determine what actions a player must perform. When the cup 50 spins, it travels freely across the board in a wobbly, very unpredictable fashion, landing upon a card transfer space 40, as is discussed more fully hereinafter.

In one preferred embodiment of the game, the player either draws cards or passes cards as dictated by the card transfer space the cup 50 comes to rest on. A peripheral wall 36 extends upwardly from the board surface 38 to retain the cup 50 on the surface 38. Preferably, the board surface 38 is flat and smooth. A series of card transfer spaces 40 are defined in the surface 38. Generally, boundary lines 39 delineate the card transfer spaces 40. Of course, other visual differentiation methods could be used (color-coding, etc.).

Card transfer spaces 40 comprises several distinct card transfer spaces 42, 44 wherein the player is directed to either draw cards or pass cards respectively. The card transfer spaces 42, 44 may be further subdivided into spaces that either direct the player to either draw or pass cards from either the deck or another player. Card transfer spaces 46 direct the player to draw or pass card(s) to the deck. Card transfer spaces 48 direct the player to draw or pass card(s) to another player. A centralized card transfer space 49 directs the player to either lose a turn or draw cards from the deck, depending upon how many cards are currently in the player's hand.

The card transfer spaces 40 generally designate a number of cards between one and five to be either drawn or passed. Of course, the number of cards transferred by the spaces as well as the arrangement of the card transfer spaces could be altered as desired to increase or decrease the difficulty of the game. Experience has shown that as more cards are transferred, words become more difficult to immediately form.

Cup 50 comprises a rotatable, beveled elliptic paraboloid 52 (FIGS. 3–6). Paraboloid 52 also resembles a truncated cone resting on its top. Paraboloid 52 comprises a beveled bottom 54 and a substantially planar top 56.

Top 56 defines an indicating system 57. Indicating system 57 comprises a circular dot 58 and a convergent arrow 59. The indicating system is used to select which card transfer space 40 the cup 50 lands upon during play, as is more fully discussed hereinafter.

Bottom 54 comprises a beveled face 60 that the cup spins upon. The diameter 64 of the bottom is smaller than the diameter 66 of the top 56. The cooperative effect of beveled face 60 and the greater diameter 66 is to eventually impart a wobbling motion to the cup 50 as it spins.

When cup 50 is spun, the player initially imparts a primarily rotational force upon the cup. However, the wobbling motion of the cup 50 results in the cup 50 frictionally engaging surface 38. The resultant reaction arising from the rotational forces of the spinning cup resisted by the frictional engagement of the surface to the cup imparts unpredictable movements upon the cup 50. Additional cup contact with wall 36 further compounds the movement vectors of the cup. The end result is that the player cannot control or predict with any certainty the movement of the cup 50. The erratic movement of the cup 50 about board 30 has proven very entrancing because of its unpredictable and visually stimulating nature.

Cards 70 are used by each player to form words during their respective turns. Each card 71 comprises a front, exposed face 72 and a rear, hidden face 73. Rear face 73 contains a letter 74 and a point value 75 associated with card 71. Preferably, at least one of the cards 70 is a chance card 76 (i.e., the "Yeah" card).

The cards are dealt to the players with the remaining cards forming a conveniently placed deck 78 from which additional cards are drawn as the game progresses. A discard pile 79 is preferably formed adjacent the deck 78 to receive cards from the players.

Initially, each player is dealt a starting hand 80 comprising ten cards 71. Of course, the initial number of cards could be varied to suit the particular desires of the players or any desired rule changes to make the game easier or more difficult to play.

After the game has progressed, a subsequent hand 82 is obtained wherein a word 83 has been formed using the cards. Of course, most players will still retain cards 84 in their hand to be used in subsequent turns. Also, on a "spin-olied" hand, a discard is placed in the center of the board 38. A final hand 85 is shown wherein a player has "spin-olied" or gone out. In hand 85, all of the held cards have been utilized except one, discard 86. The discard 86 shown in FIG. 1 also happens to be the chance card 76. Ordinarily, discard 86 is placed on board 30, preferably on central space 49.

Instructions for Play

I. Overview

The game is begun by shuffling the cards and dealing ten cards 71 to form a hand 80 to each player (FIG. 1). The remaining cards are placed face down on the table in deck 78. This deck 78 will be drawn from during play. The player to the left of the dealer begins by spinning cup 50 on the game board 30. The cup 50 will come to rest on a card transfer space 40, which will tell the player what to do.

After following the directions on the space, the player may then attempt to spell one word from the cards in his hand. The selected cards are laid face up on the table in front of him to form word 83. This completes his turn, and play proceeds to the next player. If a player cannot spell a word with the cards in his hand, play merely proceeds to the next player.

II. Spinning the Cup

Figure 10:
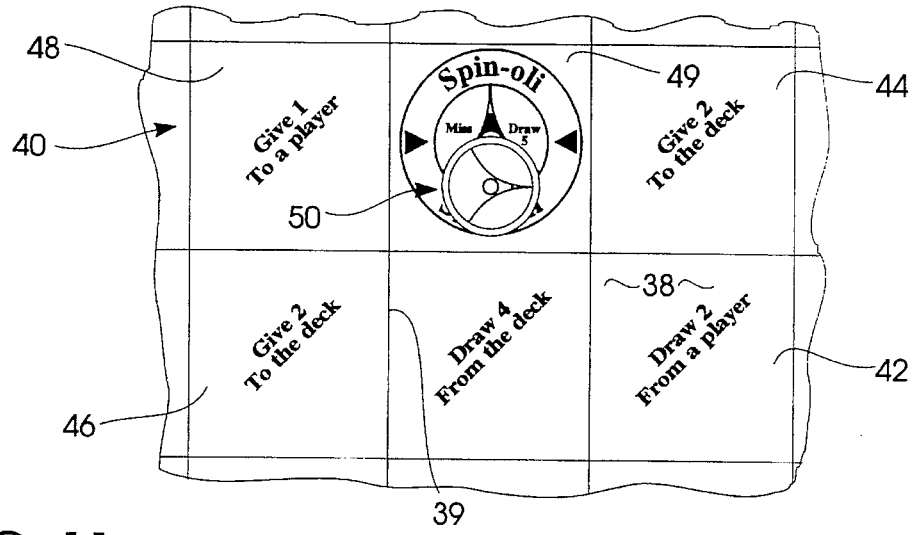
FIG. 10 is a fragmentary view of the board similar to FIG. 2, showing the cup upon a card transfer space with the dot indicating the selected space, with portions omitted for clarity.
Figure 11:
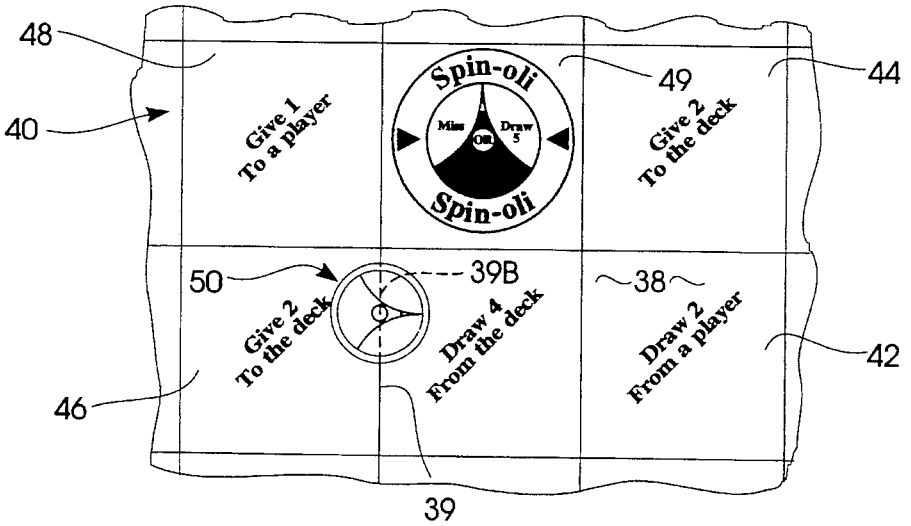
FIG. 11 is a fragmentary view of the board similar to FIG. 10 showing the cup between two card transfer spaces with the arrow indicating the selected space, with portions omitted for clarity; and, FIG. 12 is a fragmentary view of the board similar to FIGS. 10 and 11 showing the cup between card transfer spaces with the dot and the arrow unable to indicate the selected space, with portions omitted for clarity.
Figure 12:
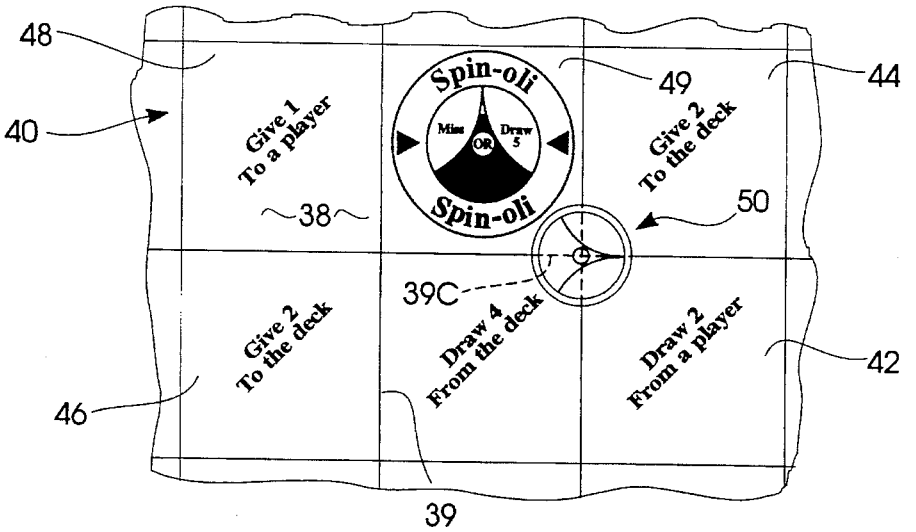

The player spins the cup 50 by placing the cup 50 anywhere on the game board 30. The player holds the cup 50 with his fingers around top 56 and gives it a sincere twist. The cup 50 freely travels about the board 30. When the cup 50 has come to rest, dot 58 in the middle of the cup 50 determines which card transfer space 49 the cup 50 has landed upon (FIG. 10). If the dot 58 comes to rest directly over a line 39B, then arrow 59 should be resting over the correct space (FIG. 11). RE-SPINS are made when: the cup 50 lands on its side; a "true line" occurs, in which both the dot 58 and the arrow 59 are directly over a line 39C or if the correct space cannot be determined for any other reason (FIG. 12); or the player's spin did not cause the cup 50 to leave the space from which he chose to spin from initially (the cup may return to the original space, but it must first leave).

III. Reading the Card Transfer Spaces

After the cup 50 lands upon a card transfer space 40, the player follows the following directions, transferring the number of cards specified by the space. The following options, with variable number of cards, are printed on the spaces:

Draw from a player (92): The player chooses another from whom to draw and, without being allowed to see the other player's cards, draws the specified number of cards. The selected cards become part of the player's hand. If the chosen player has fewer cards than dictated to be passed, you may take as many as the chosen player holds, forcing the player to become "EMPTY-HANDED" (i.e., no cards remain in the player's hand). For instance, if the player holding hand 91 had spun cup 50 and it landed on space 90, which dictates that the player draw three cards from another player, drew three cards from the player holding hand 92, the player holding hand 92 would now become "EMPTY-HANDED" (FIG. 1).

Draw from the deck (93): The player simply draws the specified quantity of cards from the top of the deck 78. The selected cards become part of the player's hand. (In the event that the deck is ever depleted during a set, the person who depleted it may finish their turn, and this ends the set and points are calculated).

Give to a player (94): The player chooses which cards will be passed from his hand and passes the card to a player of his choice. If the player's hand only contains the necessary number of cards or less the player must give all held cards and become "EMPTY-HANDED."

Give to the deck (95): The player chooses which cards will be passed from his hand and places the cards face up on discard pile 79. If the player does not have enough cards, the player must give all held cards to the discard pile 79. This forces the player to become "EMPTY-HANDED." Cards given to the discard pile 79 may not be picked up by any player at any time during a set.

Center space (49): If the player currently holds any cards, landing on space 49 results in the player losing the remainder of his turn. However, landing here while "EMPTY-HANDED" means the player gets to draw five cards from the deck 78 and play the remainder of his turn.

Of course, the number of cards transferred and the quantity and arrangement of the spaces may be altered to increase or decrease the difficulty of the game. It has been found that the more cards that change hands, the more difficult strategic planning becomes.

IV. Spelling a word

After the player has either drawn or passed cards as dictated by the card transfer space, the player attempts to spell a word using the cards 81 currently in his hand. The player arranges the cards face-up in front of him to spell the chosen word 83. A word 83 is acceptable if it is not strictly a proper noun, it does not require punctuation marks, it is not an acronym, or an abbreviation and it is spelled correctly. No one may add letters to a word which has already been laid on the table.

Opponents may challenge the player's word 83 by saying "PROVE IT." If the player refuses to change the word, the word in question is then looked up in an acceptable dictionary or the like. If the word is spelled incorrectly, the player must turn the cards face down on the table and loses them. The player does not receive any points for face down cards at the end of the set. If the word "proves" to be spelled correctly, the challenging opponent must place all of his hand-held cards face up in the discard pile 49. However, if the "proved" word was a "Spin-oli" word, the challenging opponent must keep all of his cards.

V. Empty-handedness

Any player who becomes EMPTY-HANDED during a set may only utilize spaces 44 that direct the player to draw cards. If the player lands on such a space, the player may draw the card and continue playing a full turn. Other players are not able to draw from EMPTY-HANDED opponents. If a player is directed to draw from another player and all opponents are "EMPTY-HANDED", the player does not get to draw and must continue the turn without receiving any additional cards.

A player may become EMPTY-HANDED if so desired (i.e., if the player only has enough cards to spell a word, but does not have a card to discard and "Spin-oli").

A player who is EMPTY-HANDED spins cup 50 each time it is his turn, hoping to land on a useful space 44 so that cards may be drawn. If the player fails to do so, it is the next player's turn. However, if on the third consecutive turn, the player remains EMPTY-HANDED, the player may draw 5 cards from the deck 78, and continue his turn.

VI. Spin-Oli

During his turn, the player who wishes to "go out" says "Spin-oli" and must be able to spell a word 83B from his hand, (which he lays face up on the table). The player must also have one card 88 to discard. The discard 88 is placed face-up on the board. The set is over, and points are calculated.

No one is permitted to "Spin-oli" on his first turn within a set. The player who has just "Spin-olied" receives 30 points for having done so, plus the point value of each card he has on the table (the discard does not count). This is his total for the set and is written on the score sheet under the player's name.

After a player has "Spin-olied", the other players may also receive points for the set if they already had words 83 on the table at the time the set ended. If so, the total point value for each letter of the spelled words must exceed the total point value of the held cards. The player deducts the value of the held cards 84 from the total value of each letter of the spelled words, taking the difference as his score for the set. If the point value of the spelled words does not exceed the point value of the held cards, the player receives a zero. (No one ever receives a "minus" score). This ends the first set. Deal moves to the left to begin a new set. The first player to reach 300 points wins.

VII. The Chance card

Preferably, at least one of the cards is a chance card 76 (the "Yeah" card). If the "YEAH" card is used as the discard in by a player during a "Spin-oli", it doubles the total score for that player's set. However, any player caught holding the "YEAH" card when an opponent "Spin-olies" automatically receives a zero score for the set, regardless of the point value of any spelled words on the table.

Additionally, no player may pass the "Yeah" card to the discard pile 79. If the player is forced to pass more cards than he is holding to the pile 79, the player still cannot pass the "Yeah" card to the pile 79. However, the "Yeah" card can be transferred to another player.

From the foregoing, it will be seen that this invention is one well adapted to obtain all the ends and objects herein set forth, together with other advantages which are inherent to the structure.

It will be understood that certain features and subcombinations are of utility and may be employed without reference to other features and subcombinations. This is contemplated by and is within the scope of the claims.

As many possible embodiments may be made of the invention without departing from the scope thereof, it is to be understood that all matter herein set forth or shown in the accompanying drawings is to be interpreted as illustrative and not in a limiting sense.

What is claimed is:

1. A word forming game for two or more players, said game comprising:

playing card means for generating a score, said playing card means comprising:

letter cards for forming words when a player has a turn, each letter card displaying a letter and a point value to be awarded the player when a word is formed employing said card; and, at least one chance card for multiplying said score;

a game board comprising:

a plurality of card transfer spaces specifying a number of cards to be either drawn by a player or passed by a player during his or her turn; and, boundary means for visually separating said transfer spaces from one another;

spinner means thrown by each player upon said board during his or her turn for randomly selecting a card transfer space during play of said game, said spinner means comprising indicator means for selecting a particular space when the spinner means comes to rest, said indicator means comprising:

a dot for selecting a space if the dot does not overly said boundary means when the spinner means comes to rest upon said board; and, an arrow that points to a space to be used by a player if the dot does overly said boundary means line when the spinner means comes to rest upon said board; and, means for confining said spinner means to said board.

2. The word forming game as defined in claim 1 wherein said spinner means comprises a rotatable body in the form of an elliptical paraboloid.

3. The word forming game as defined in claim 1 wherein said spinner means comprises a body having a top and a bottom, said body top having a diameter larger than said body bottom.

4. A word forming game for two or more players, said game comprising:

a plurality of playing cards for forming words when a player has a turn, each card having a face displaying a letter and a point value to be awarded the player when a word is formed employing said card;

a game board adapted to be disposed upon a supporting surface, said board comprising a plurality of card transfer spaces specifying a number of cards to be either drawn by a player or passed by a player during his or her turn;

spinner means thrown by each player upon said board for randomly selecting a card transfer space during play of said game, said spinner means comprising a rotatable body in the form of an elliptical paraboloid.

5. The word forming game as defined in claim 4 wherein said body comprises a top and a bottom, said top having a diameter larger than the diameter of said bottom.

6. The word forming game as defined in claim 5 wherein said spinner means top comprises indicator means for selecting a particular space.

7. The word forming game as defined in claim 6 wherein:

said board comprises boundary means for defining said card transfer spaces; and, said indicator means comprises a dot for selecting a space if the dot does not overly said boundary means when the spinner means comes to rest, and an arrow that points to a space to be used by a player if the dot does overly said boundary means.

8. The word forming game as defined in claim 4 wherein said board comprises a peripheral wall surrounding said card transfer spaces for limiting travel of said spinner means.

9. The word forming game as defined in claim 4 wherein said body comprises a flat top and a generally convex exterior extending downwardly from said top to a substantially arcuate bottom, said bottom having a smaller diameter than said top, wherein said spinner is adapted to wobble about said bottom.

10. The word forming game as defined in claim 4 wherein said plurality of cards comprises at least one chance card without a letter thereupon.

11. A word forming game for two or more players, said game comprising:

a plurality of playing cards for forming words when a player has a turn, each card having a face displaying a letter and a point value to be awarded the player when a word is formed employing said card;

a game board comprising a plurality of card transfer spaces defined by a plurality of lines, each of said spaces specifying a number of cards to be either drawn by a player or passed by a player during his or her turn;

spinner means thrown by each player upon said board during his or her turn for randomly selecting a card transfer space during play of said game, said spinner means comprising indicator means for selecting a particular space when the spinner means comes to rest, said indicator means comprising a dot for selecting a space if the dot does not overly a line when the spinner means comes to rest upon said board, and an arrow that points to a space to be used by a player if the dot does overly a line; and, a peripheral wall surrounding said card transfer spaces for confining said spinner means to said board.

12. The word forming game as defined in claim 11 wherein said spinner means comprises a rotatable body in the form of an elliptical paraboloid.

13. The word forming game as defined in claim 11 wherein said spinner means comprises a top and a bottom, the top of said body having a diameter larger than the diameter of said bottom.

14. A word forming game for two or more players, said game comprising:

a plurality of playing cards for forming words when a player has a turn, each card having a face displaying a letter and a point value to be awarded the player when a word is formed employing said card;

a game board adapted to be disposed upon a supporting surface, said board comprising a plurality of card transfer spaces delineated by a plurality of lines, each of said spaces specifying a number of cards to be either drawn by a player or passed by a player during his or her turn;

spinner means thrown by each player upon said board for randomly selecting a card transfer space during play of said game, said spinner means comprising a top and a bottom, the top of said body having a diameter larger than the diameter of said bottom, said spinner means top comprising indicator means for selecting a particular space, said indicator means comprising a dot for selecting a space if the dot does not overly one of said lines when the spinner means comes to rest, and an arrow that points to a space to be used by a player if the dot does overly one of said lines.

* * * * *